US006467315B2

(12) United States Patent
Edmondson

(10) Patent No.: US 6,467,315 B2
(45) Date of Patent: Oct. 22, 2002

(54) ANTI-THEFT BOAT LOCKING MECHANISM

(75) Inventor: Jack M. Edmondson, Cunningham, TN (US)

(73) Assignee: JME Products Corporation, Atlanta, GA (US)

( * ) Notice: Subject to any disclaimer, the term of this patent is extended or adjusted under 35 U.S.C. 154(b) by 0 days.

(21) Appl. No.: 09/738,189

(22) Filed: Dec. 15, 2000

(65) Prior Publication Data

US 2001/0001926 A1 May 31, 2001

Related U.S. Application Data

(63) Continuation-in-part of application No. 09/415,419, filed on Oct. 8, 1999, now abandoned.

(51) Int. Cl.[7] ..... E05B 73/00

(52) U.S. Cl. ..... 70/14; 70/18; 70/19; 70/58; 70/209; 114/218

(58) Field of Search ..... 70/14, 18, 19, 70/57, 58, 209, 226, 237, 238, 199, 211, 234; 114/218, 230.2

(56) References Cited

U.S. PATENT DOCUMENTS

| | | | | |
|---|---|---|---|---|
| 1,837,683 A | | 12/1931 | Skaggs | 70/18 |
| 2,479,300 A | | 8/1949 | Binz | 70/232 |
| 2,912,847 A | | 11/1959 | Putman et al. | 70/232 |
| 2,984,096 A | | 5/1961 | Putman et al. | 70/58 X |
| 4,807,453 A | | 2/1989 | Bernier et al. | 70/233 |
| 5,179,847 A | | 1/1993 | Dorn | 70/18 |
| 5,239,849 A | * | 8/1993 | Gallardo | 70/63 X |
| 5,259,222 A | | 11/1993 | Jang | 70/238 X |
| 5,435,158 A | | 7/1995 | Ta-Yung | 70/226 X |
| 5,588,316 A | | 12/1996 | Jones | 70/163 X |
| 5,639,001 A | | 6/1997 | Brady | 70/226 X |
| 5,701,771 A | | 12/1997 | Bailey | 70/233 |
| 5,706,680 A | | 1/1998 | Wroble | 70/18 |
| 5,778,709 A | | 7/1998 | Hsu | 70/226 X |
| 5,873,319 A | | 2/1999 | Bentley | 114/230.2 |
| 5,953,941 A | | 9/1999 | Freund | 70/199 |
| 5,992,192 A | | 11/1999 | Tual et al. | 70/233 |
| 6,000,255 A | | 12/1999 | Lester | 70/226 |
| 6,041,729 A | | 3/2000 | Alan | 114/230.2 |

FOREIGN PATENT DOCUMENTS

| | | | |
|---|---|---|---|
| AU | 89046851 | 6/1991 | 70/226 |

* cited by examiner

*Primary Examiner*—Lloyd A. Gall
(74) *Attorney, Agent, or Firm*—Hinkle & O'Bradovich, LLC

(57) ABSTRACT

An anti-theft device for water craft to secure boats and to secure accessories in three embodiments. The first embodiment discloses a two part locking mechanism comprising a tubular locking bar which reciprocates into locking relationship with a tubular locking cylinder. Both the locking bar and the locking cylinder have projecting and bent locking legs of elongated length configured to enclose the horns of a cleat in secure relationship. The locking bar is capable of being reciprocated into the locking cylinder and locked therein to maintain the locking legs around the horns of the cleat. The second embodiment discloses a locking bar and locking cylinder arrangement wherein the horn engaging locking legs are of relatively thin wall tubular construction and fit around the horns of the cleat. In the third embodiment the horn engaging legs are of circular ring construction and are attached respectively to the locking bar and locking cylinder as described in the other embodiments.

4 Claims, 4 Drawing Sheets

Fig_2
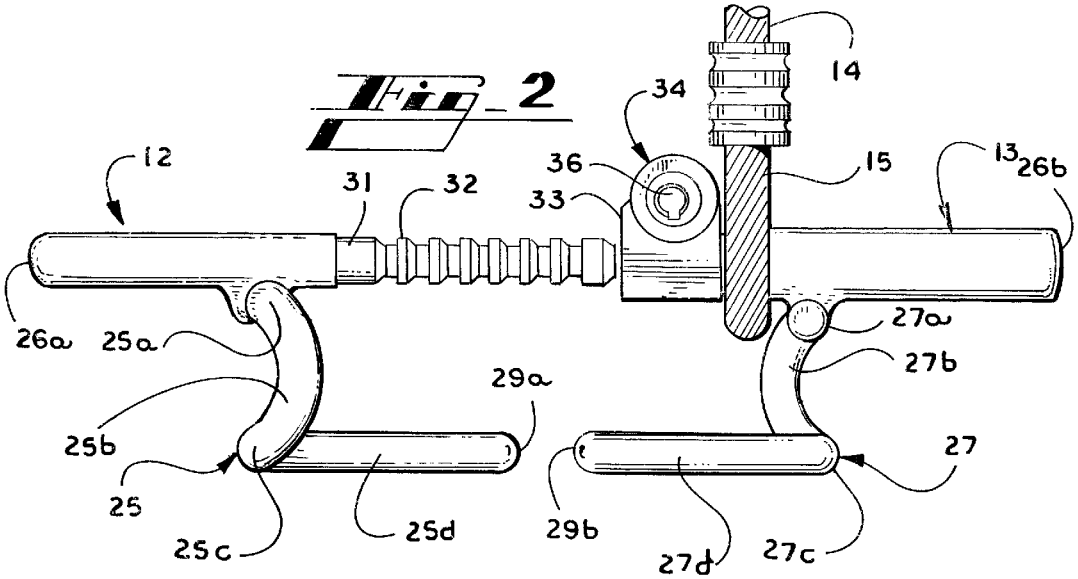
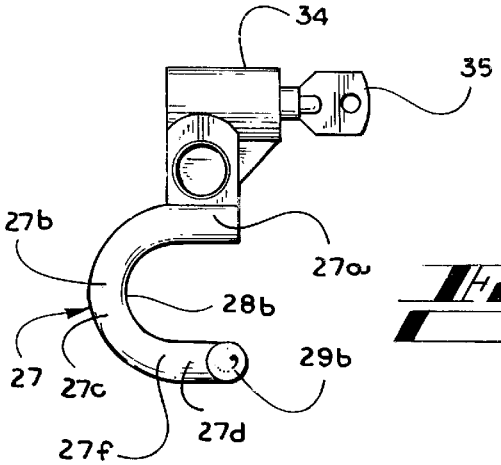
Fig_4
Fig_3
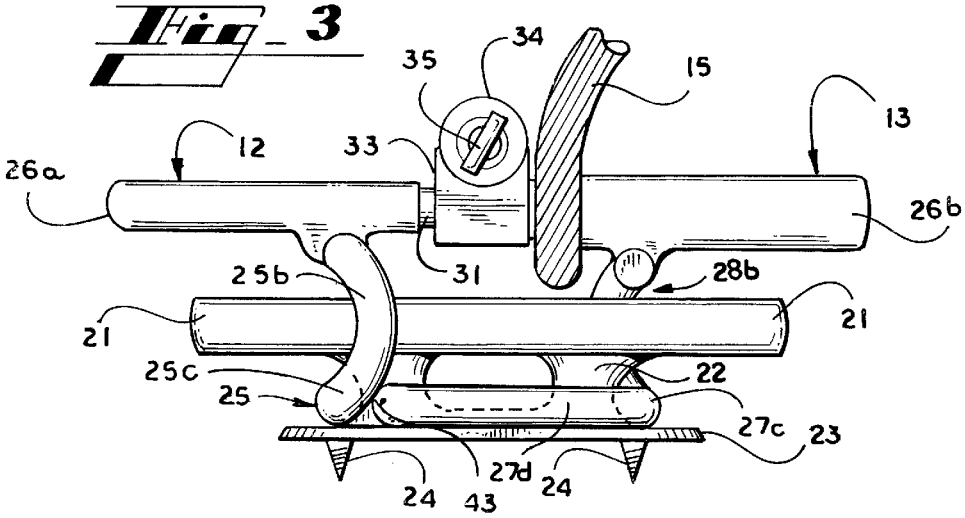

ANTI-THEFT BOAT LOCKING MECHANISM

REFERENCE TO RELATED APPLICATIONS

This application is a continuation-in-part of application Ser. No. 09/415,419 filed on Oct. 8, 1999, now abandoned.

BACKGROUND OF THE INVENTION

I Field of the Invention

The present invention relates generally to the field of locking and securing devices and more particularly, the invention relates to an adjustable water craft anti-theft device designed to secure boats at a dock and to secure watecraft equipment in either a dock environment or to a water craft.

II. Description of the Related Art

The securing of water craft and associated equipment at marinas and at dockside poses substantial problems. Even in a relatively secure marina, boats and their equipment are easily stolen by a dedicated thief. Typically, boat thieves operate at night and sometimes they won't even bother to break into a cabin. Instead they will "hot wire" the ignition if that is accessible. The thief will then motor away to a quiet spot and, by first light, can have changed the boat's name, registration number and sometimes even the trim colors. While very large boats do not lend themselves particularly to the present invention, certainly equipment aboard large boats can easily be protected by this invention. The present invention relates more nearly to smaller type boats and dinghies and will have applicability to larger boats as appropriate.

While no safeguard is entirely fool proof against a professional and dedicated thief, the goal of the boat owner should be to reduce the opportunities for amateur thieves and to make it as hard as possible for the professionals. Dinghies, especially inflatables, are popular items for surreptitious removal from dockside or from tethers at the main boat. Dinghies usually disappear when they are in the water and tied to a parent boat or a pier. Since dinghies and their outboard engines are expensive items, these are typically stolen with great regularity.

In the past there have been numerous types of devices utilized to secure outboard engines to dinghies, and dinghies to either the parent boat or to a dock, and typically these devices have been a chain with a padlock or a hardened, braided steel cable and a padlock. However, it is typically difficult to find securing hard spots either on the parent boat or a dock to which one can attach a cable and/or a chain with a padlock. Therefore, the goal of the owner is to slow down the thief and to send the thief off in search of easier prey. Therefore, while police experts advise attaching the boat and/or associated accessory equipment to a dock by a hardened chain or cable with a padlock, and since it is difficult to find places to attach either the chain or cable to the boat or to the dock, the most obvious place to attach such a locking device would be to a bollard or to a boat cleat firmly affixed to the dock. The prior art does not know of devices which will specifically attach to a cleat.

For instance, the patent to Jang (No. 5,259,222 ) discloses a stick-shaped car lock device having a sliding lock bar on which circumferential grooves are provided and wherein the lock bar telescopes into a locking cylinder. At the respective ends of the locking device are double U-shaped hooks projecting from the lock bar and the locking cylinder. Each of the U-shaped hooks have all of the elements thereof in a common place. At the midpoint of the locking cylinder, there is a single U-shaped hook having all portions lying in a single plane. The lock device can either lock the steering wheel of a car or lock the combination of the steering wheel and the brake pedal. None of the hooks are in close enough proximity to one another to be able to impinge upon, or interlock with, any of the other hooks to effectively surround an item to be secured thereby to prevent rotation of the locked item within the confines of the lock device.

The patents to Putman et al (U.S. Pat. Nos. 2,912,847 and 2,984,096 ) disclose an outboard motor lock which fits around the screw heads of the motor retaining screws to prevent the screws from being unscrewed from the boat transom. The lock comprises nothing more than a pair of telescoping tubes having a slot in each tube cut from one end of each tube a desired distance along the tube wall and designed to encompass the screws to allow the respective tube to enclose the screw heads to prevent the screw heads from being rotated. After the screw heads are encompassed in the telescoping tubes, a lock is placed through the tubes to lock the tubes together.

The devices of the prior art, while effective in limited situations, were never sufficient to handle securing boats and equipment situations over a wide variety of situations. For instance, prior devices could not handle with one device, cleat-to-cleat securing, cleat to post securing, large boat securing, small boat and dinghy securing along with the securing of houseboats, cruisers, sailboats and the securing of equipment such as outboard engines.

SUMMARY OF THE INVENTION

In accordance with the present invention and the contemplated problems which have and continue to exist in this field, the objectives of this invention are to provide an adjustable locking and securing anti-theft device for water craft designed to secure boats at a dock, and to secure water craft equipment either to the parent boat or to a dock by utilization of a braided aircraft type steel cable attached to a specialized, adjustable locking fitting which may be utilized in a manner not heretofore known.

The present invention is applicable to the following situations, among others:

(a) Boat cleat to dock cleat.

(b) Boat cleat to dock bollard or post.

(c) Boat cleat to mooring ring.

(d) Boat cleat to dinghy or tender cleat.

(e) Boat cleat to accessories by looping the cable around the accessory.

The invention accomplishes the above and other objectives with a specialized adjustable anti-theft water craft locking mechanism having specialized fittings which will fit around and about various size and style of cleats and rings which will be impossible to remove without great effort. The invention described herein accomplishes these objects with three (3) separate embodiments. The first embodiment discloses a locking mechanism having a serrated sliding lock bar capable of sliding into a locking cylinder, and wherein each half of the locking mechanism has attached a locking leg of steel bent to a specific shape to encompass the horns of the base of the cleat and to be slidingly engaged therewith when the sliding lock bar is securely fastened to the locking cylinder. Additionally, the mechanism is so shaped that the locking legs interact with one another so that when completely closed, the interaction of the locking legs will prevent rotation of the two halves of the main body and subsequent opening when the locking legs are enclosing a cable or a mooring ring in a securing situation.

Another embodiment discloses a locking system in which the horns of the cleat are totally encompassed by an elongated tubular securing ring on each of the sliding lock bar and the locking cylinder, and wherein the securing ring has a substantial length to encompass the large portion of the cleat horns. In all instances, the sliding lock bar and the locking cylinder, and associated locking mechanisms, are the same.

Another embodiment of the invention discloses a similar type of cleat engaging mechanism wherein the locking legs are replaced, for economy sake, with steel rings attached to the sliding lock bar and the locking cylinder so that the horns of the cleat would fit within the circular rings to accomplish the locking action.

Other objects, advantages and capabilities of the invention will become apparent from the following description taken in conjunction with the accompanying drawings showing the preferred embodiment of the invention.

BRIEF DESCRIPTION OF THE DRAWINGS

FIG. 2 is a side elevation view of the embodiment shown in FIG. 1 prior to the halves of the invention being slidingly engaged;

FIG. 3 is a side elevation view of the embodiment of FIG. 1 showing the invention fully engaged around a cleat;

FIG. 4 is a end elevation view of the locking cylinder half of the invention;

DESCRIPTION OF THE PREFERRED EMBODIMENTS

Figure 1:
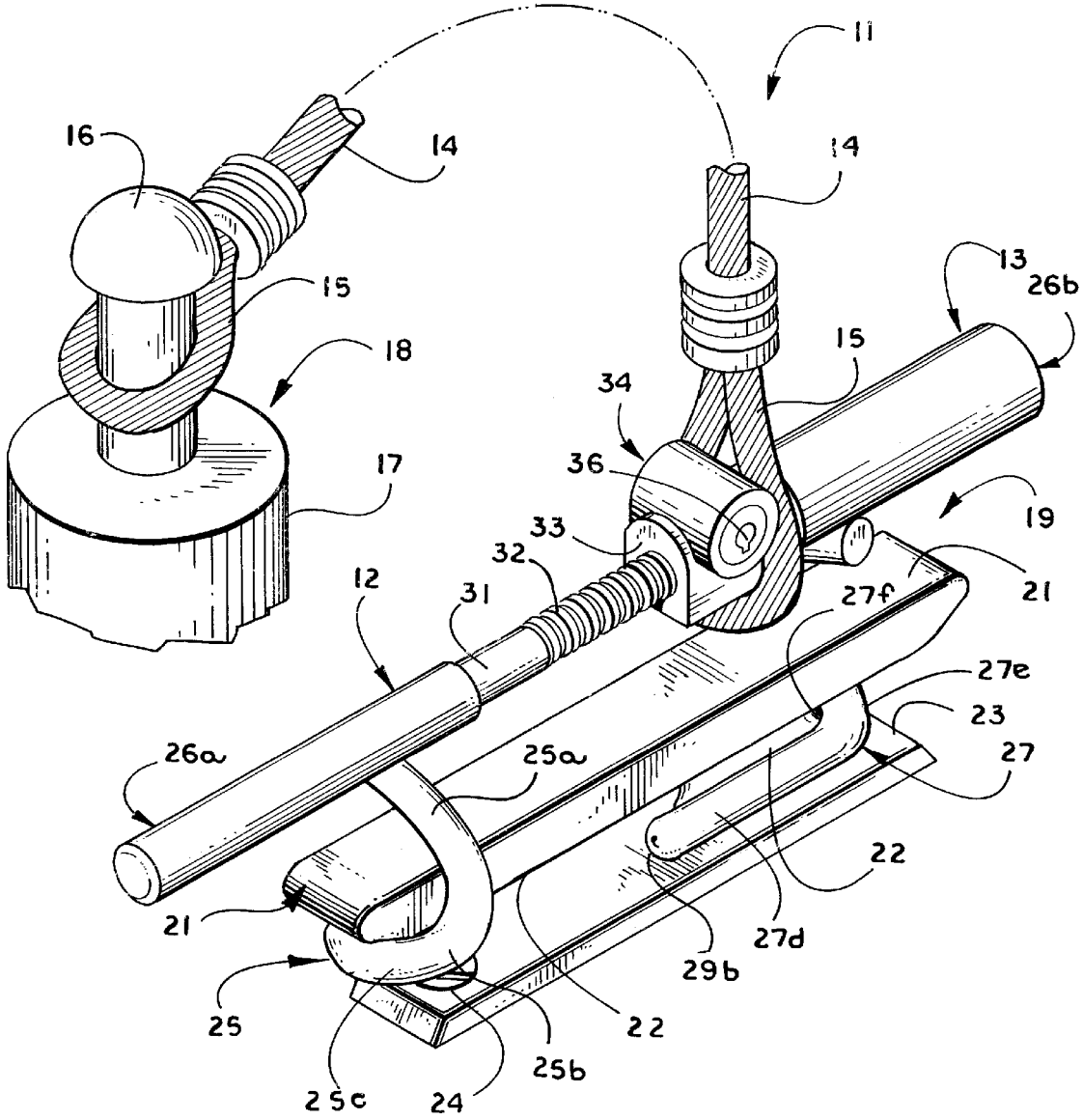
FIG. 1 is an overall perspective view of the first embodiment of the invention showing the specialized lock attached to a water craft cleat and secured to a dock post.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to the embodiment shown in FIGS. 1–4. The embodiment of FIG. 1 discloses the invention affixed to a dock cleat with a cable attached to the invention and being affixed to a mounting post on the dock. It should be noted that the invention may very well have a pair of cleat locking mechanisms attached to the cable, one at either end, so as to effect a locking system between a cleat on a boat and a cleat on a dock. Generally, the invention comprises an anti-theft boat locking mechanism 11 comprising a sliding lock bar 12 which reciprocates in and out of a locking cylinder 13. Attached to the mechanism 11 is preferably a braided, aircraft style vinyl coated cable 14 which, as alluded to earlier, may have a mechanism 11 attached at either end. In the case shown in FIG. 1, one end of the cable is shown having a loop 15 which is attached to the heavy gauge metal bolt 16 affixed into a dock post 17 which would represent a dock bollard 18. In this particular fashion, the mechanism 11 would remain fixed to the dock and be utilized to clamp onto a cleat on a boat. In the alternative, the cable end which is shown on the dock bollard 18 could, in fact, be attached to a second locking mechanism 11 which would then be attached to a dock cleat.

The cleat 19 is of standard type construction and generally includes opposing cleat horns 21 attached to one or more cleat legs 22 which interconnect the horns 21 to the cleat base 23. Typically, cleats come in many sizes and configurations and are screwed to a dock or to a boat and secured by cleat securing screws 24 which, if properly through bolted, will make it difficult to remove the cleat. The present invention, especially with the embodiment of FIG. 1, will make it extremely difficult to remove the cleat as will be later described.

The sliding lock bar 12 and the locking cylinder 13 both have mating securing locking legs of hardened steel firmly affixed to the respective halves. With respect to the sliding lock bar 12, the securing locking leg 25 is firmly attached to the distal end 26*a* of the lock bar 12. With respect to locking cylinder 13, the securing locking leg 27 is firmly affixed to the distal end 26*b* of the locking cylinder 13. As can be seen, the length of the securing locking legs 25 and 27 are not co-planar with the lock bar 12 and the locking cylinder 13. Each securing locking leg curves around in the manner back on itself in a reentrant manner, and then bends at the distal end thereof to place the terminating end portion of the locking leg in a co-planar relationship with the respective lock bar 12 or locking cylinder 13. The distal end of each locking leg 25 and 27 then terminates with respective rounded terminating ends 29*a* and 29*b*. In this manner, as can be seen in FIGS. 1 and 3, the securing locking legs 25 and 27, when placed around cleat legs 22, will encompass the cleat legs on opposite sides thereof and the reentrant portion of each securing locking leg will also encompass the cleat horns 21, both underneath the horn and on top of the horn, thereby firmly securing the locking mechanism 11 to the cleat.

Figure 11:
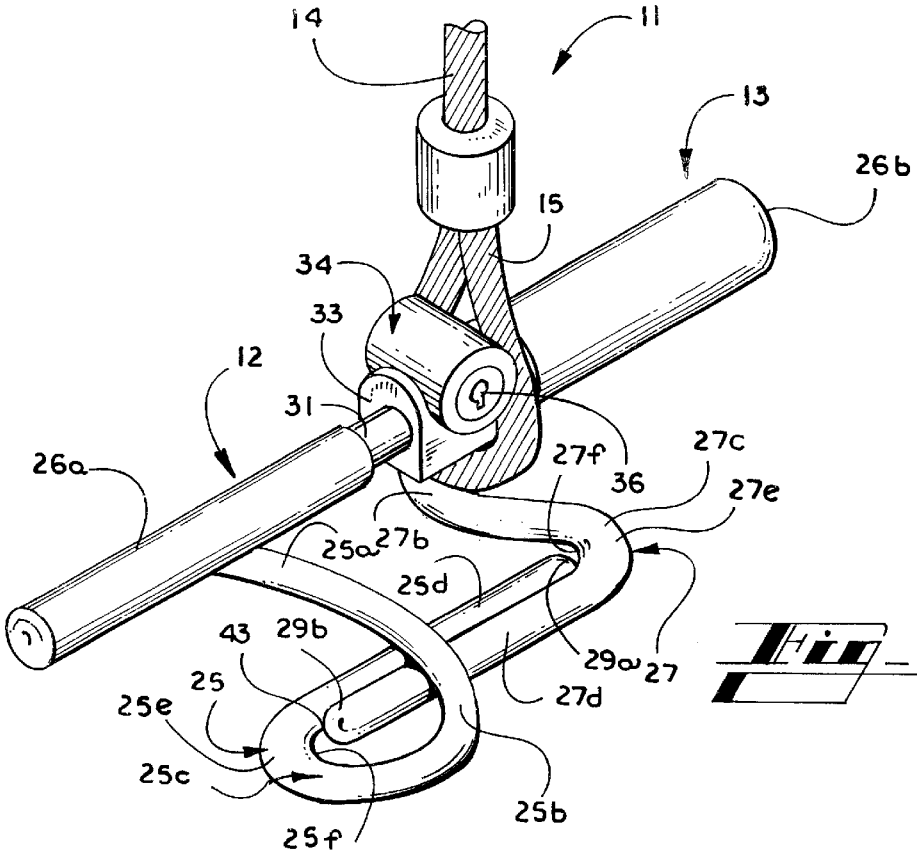
FIG. 11 is a perspective view of the first embodiment without a secured device to show the relationship of the locking legs when in a fully closed and interlocking position.

The locking legs 25 and 27, as easily seen in FIG. 11, are subdivided into multiple sectors, all of which allow interaction to permit the mechanism to function in its intended mode. Locking leg 25 projects from lock bar 12 radially outward in an initial sector 25*a* and continues in a curvilinear loop sector 25*b* which extends toward the distal end 26*a* of lock bar 12. Thence, the curvilinear loop sector 25*b* flows into the reentrant loop sector 25*c* which projects generally toward the center line of lock bar 12 and thence bends into the elongated substantially straight sector 25*d*, which is substantially parallel to the center line of lock bar 12. Where the reentrant loop sector 25*c* bends into the elongated sector 25*d*, as indicated by numeral 25*e* there is formed an acute rounded interior angle 25*f*.

Similarly with respect to locking leg 27, it is seen that leg 27 projects from locking cylinder 13 radially outward in an initial sector 27*a* and continues in a curvilinear loop sector 27*b* which extends toward the distal end 26*b* of locking cylinder 13. Thence, the curvilinear sector 27*b* flows into the reentrant loop sector 27*c* which projects generally toward the center line of locking cylinder 13 and thence bends into the elongated substantially straight sector 27*d*, which is substantially parallel to the center line of locking cylinder 13. Where the reentrant loop sector 27*c* bends into the elongated sector 27*d* as indicated by numeral 27*c*, there is formed an acute rounded interior angle 27*f*.

In order to maintain the locking mechanism in its operative lock position, the sliding lock bar 12 is reciprocated into the locking cylinder 13 as shown in FIG. 1. The sliding lock bar 12 has an elongated shaft 31 with a portion of the shaft having adjusting serrations 32 around the shaft. In operation, the shaft 31 is placed into one end of locking cylinder 13 at receiving end 33. The locking cylinder 13 is hollow to the extent that it will receive the shaft 31, and as the shaft 31 and the serrations 32 on the shaft are reciprocated into locking cylinder 13, the serrations interact with a locking lug (not shown) within the lock 34 which is of standard tubular construction utilizing a barrel type key 35 placed into the circular keyhole 36. The shaft 31 is reciprocated into the locking cylinder 13 until the securing locking legs 25 and 27 are firmly engaged with cleat legs 22. At that point, the locking lug (not shown) of the lock 34 firmly engages a discrete serration 32 and maintains the shaft 31 in a fixed relation with respect to the locking cylinder 13, until such time as a user unlocks the device by means of key 35 in the lock 34. As is easily seen in FIG. 3, once the locking mechanism 11 has been placed around a cleat in the locking configuration, the locking mechanism 11 cannot be rotated off of the cleat because of the opposing terminating ends 29*a* and 29*b* of the securing locking legs 25 and 27. In addition, the securing locking legs 25 and 27, when properly closed upon the cleat, will overlie the cleat securing screws 24 thereby making it impossible to remove the screws and the cleat to defeat the locking mechanism.

It should be understood that, while the mechanism 11 is applicable to many securing applications, the primary ones involve cleats. When properly positioned, the reentrant portion 25*c* and 27*c* of the respective locking legs 25 and 27 are so formed to bend the respective leg in a direction opposite to the original direction of the leg coming from the lock bar 12 and/or locking cylinder 13. Such a construction allows the cleat legs 22 to be encircled by the engaging angle portion 25*e* and 27*e* of respective locking legs 25 and 27, and to place the terminating ends 29*a* and 29*b* on opposite sides of the cleat so as to prevent removal therefrom.

Figure 5:
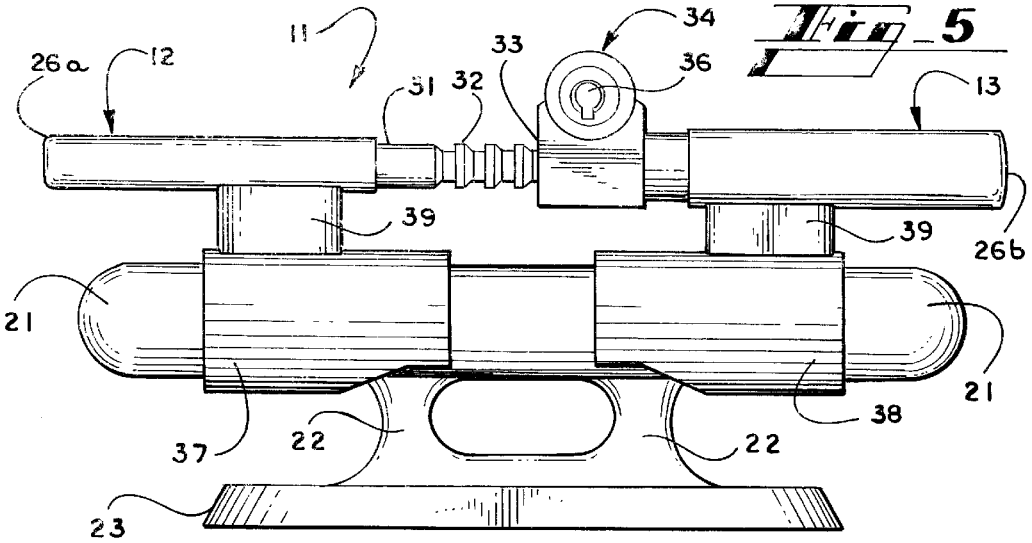
FIG. 5 is a side elevation view of a second embodiment of the invention shown placed around a cleat and locking configuration.
Figure 6:
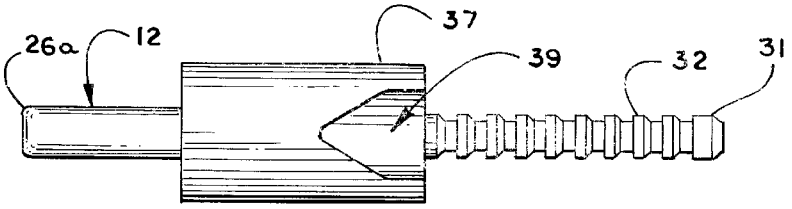
FIG. 6 is a bottom view of the sliding lock bar section of the embodiment of FIG. 5.
Figure 7:
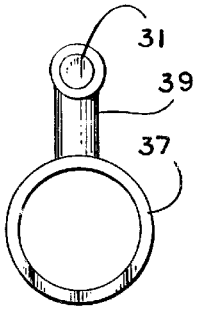
FIG. 7 is an end elevation view of the sliding lock bar of FIG. 5.

An alternative embodiment of the present invention, as shown in FIGS. 5, 6 and 7, utilizes the same sliding locking bar 12 which reciprocates into the locking cylinder 13 and is locked by circular key lock 34. However, instead of a securing locking leg as disclosed in the embodiment of FIG. 1, the invention contemplates having an elongated tubular securing ring 37 attached to sliding lock bar 12 and an elongated tubular securing ring 38 attached to locking cylinder 13 by means of an attachment mount 39. As is to be noted, the cleat used in this embodiment is essentially the same type of cleat as shown in the embodiment of FIG. 1 having a rounded type of horn 21, however, any type of cleat of known configuration will work with either embodiment of the invention. In this particular embodiment, the securing tubes 37 and 38 would be of sufficient diameter to encompass the horns 21 of the cleat. In order for each tubular securing tube 37 and 38 to fully engage the cleat, the underside of the tube will have a suitable cutout 39 which will allow the securing rings to fully engage the cleat legs 22 and to allow the full cooperation of shaft 31 to be reciprocated to a full depth with the locking cylinder 13.

Figure 8:
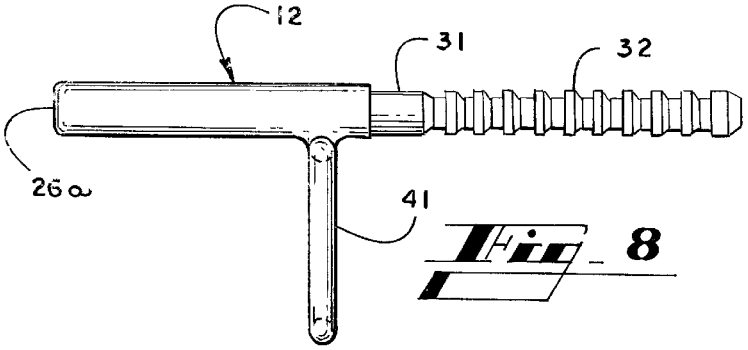
FIG. 8 is a side elevation view of the sliding lock bar of a third embodiment of the invention.
Figure 9:
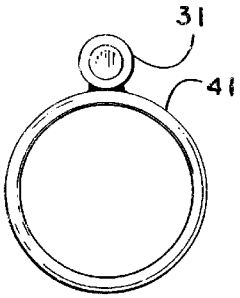
FIG. 9 is an end elevation view of FIG. 8.

Yet another embodiment of the invention is shown in FIGS. 8–9, and includes the same essential elements of the invention as previously disclosed which will include the sliding locking bar 12 and the locking cylinder 13 and the associated lock 34, along with any cable 14 necessary. The cleat securing rings of this embodiment include generally round, tubular solid rings 41 attached to the sliding lock bar 12 and to the locking cylinder 13 in order that each securing ring will be firmly attached thereto and will have sufficient diameter so that the ring 41 will fit around the cleat horns 21. The embodiment of FIGS. 8–9 will be operatively connected to a cleat 19 in the same manner as described for the other embodiments as described here and above. The only difference being that the cleat horn securing rings are solid and circular in configuration as opposed to being either tubular or bent in a reentrant curve manner.

Figure 10:
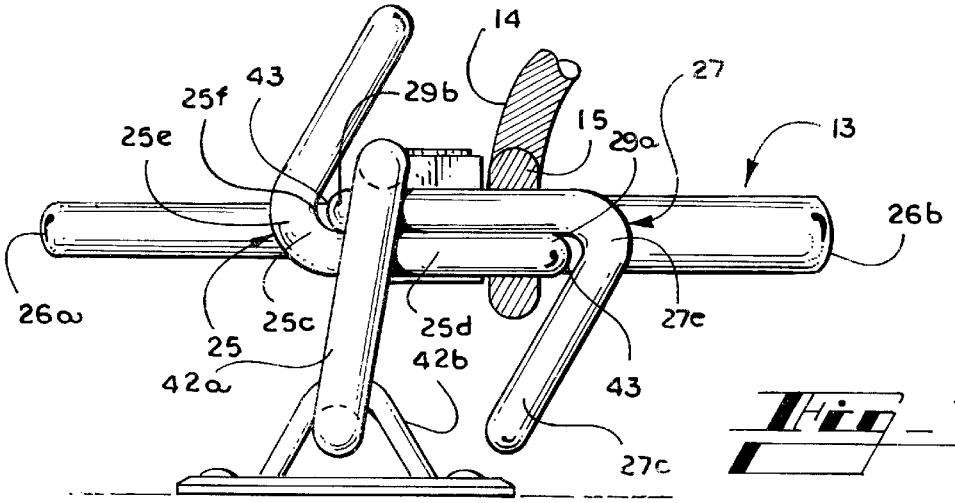
FIG. 10 is a bottom view of locking legs of the first embodiment in fully closed and interlocking position to show the legs engaging a dock ring or mooring ring.

However, in a situation where mechanism 11 is used through a mooring ring 42 , as shown in FIG. 10, or will be used around its own cable 14 to form a cable loop, there is a requirement to prevent turning of shaft 31 within locking cylinder 13, which turning could open up the space between the legs of locking legs 25 and 27 and allow the mooring ring 42*a* or the cable to be released. Therefore, each reentrant curved portion 25*c* and 27*c* project from the respective locking legs 25 and 27 toward the centrally located lock 34 a few degrees so that when the shaft 31 is fully engaged in locking cylinder 13 the respective distal terminating ends 29*a* and 29*b* are juxtaposed to the respective reentrant curved portion 27*c* and 25*c* of locking legs 25 or 27, as indicated in FIGS. 10 and 11 by numeral 43, which will prevent a turning movement and subsequent opening.

As seen in FIG. 10, distal ends 29*a* and 29*b* of formed rods 25 and 27 are juxtaposed to the interior acute angles 25*c* and 27*c* when the mechanism 11 is fully closed with both formed rods 25 and 27 secured within ring 42*a*. In this manner, with the close juxtaposition of the rod ends to the angles 25*c* and 27*c*, it can be seen that the two rods 25 and 27 cannot be rotated to any great degree and the rotation is limited to the space defined by the bent rod on either side of the acute angle 25*c* and 27*c* If the rods 25 and 27 were not so positioned when used with the ring 42*a*, or if so used if cable 14 was coiled and used as a ring, the lock bar 12 and cylinder 13 could be rotated relative to one another thereby allowing the legs to possibly move apart permitting a ring, such as ring 42*a*, to become disengaged, especially if bar 12 and cylinder 13 were not fully closed. The configuration just described provides a fail-proof locking system.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A locking system comprising:

an elongated sliding lock bar having a proximal end and a distal end;

a locking cylinder having a proximal end and a distal end;

the lock bar and the locking cylinder having a common centerline for telescoping engagement of the lock bar and the locking cylinder, an imaginary plane passing through the portion of the centerline, passing through the lock bar, a separate imaginary plane passing through the portion of the centerline passing through locking cylinder;

a locking leg attached between the proximal end and the distal end of the lock bar, and a locking leg attached between the proximal end and the distal end of the locking cylinder;

the locking legs projecting in opposite directions from one another from the respective lock bar and locking cylinder;

each locking leg being of a continuous length and subdivided into multiple sectors;

the locking leg attached to the lock bar projecting radially outward from the lock bar to comprise an initial sector, a second sector continuing from the initial sector in a curvilinear line, the curvilinear line of the second sector depending from the initial sector a predetermined distance, a third sector continuing from the second sector wherein the third sector comprises a reentrant portion of the locking leg and projecting toward the imaginary plane of the lock bar, a fourth sector continuing from the third sector wherein a portion of the fourth sector forms an acute angle with the third sector, and a last portion of the fourth sector lying in the imaginary plane of the lock bar;

the locking leg attached to the locking cylinder projecting radially outward from the locking cylinder to comprise an initial sector, a second sector continuing from the initial sector in a curvilinear line, the curvilinear line of the second sector depending from the initial sector a predetermined distance, a third sector continuing from the second sector wherein the third sector comprises a reentrant portion of the locking leg and projecting toward the imaginary plane of the locking cylinder, a fourth sector continuing from the third sector wherein a portion of the fourth sector forms an acute angle with the third sector, and a last portion of the fourth sector lying in the imaginary plane of the locking cylinder, and being parallel to the last portion of the fourth sector of the locking leg attached to the lock bar; and locking means to maintain the lock bar and the locking cylinder in selective fixed relationship.

2. A locking system as claimed in claim 1, wherein the proximal end of the lock bar has a plurality of serrations around the circumference thereof.

3. A locking system as claimed in claim 2, wherein the locking cylinder has a hollow interior adapted to accept the proximal end of the lock bar thereinto for locking engagement.

4. A locking system as claimed in claim 3, wherein the locking means comprises a key lock mounted in conjunction with the locking cylinder.

* * * * *